US007124552B2

(12) United States Patent
Lang

(10) Patent No.: US 7,124,552 B2
(45) Date of Patent: Oct. 24, 2006

(54) DEVICE FOR SCREWING SCREW-TYPE CLOSURES ONTO CONTAINERS

(75) Inventor: Horst Lang, Barbing/Auburg (DE)

(73) Assignee: Krones AG, Neutraubling (DE)

( * ) Notice: Subject to any disclaimer, the term of this patent is extended or adjusted under 35 U.S.C. 154(b) by 587 days.

(21) Appl. No.: 10/311,180

(22) PCT Filed: Apr. 30, 2002

(86) PCT No.: PCT/EP02/04739

§ 371 (c)(1),
(2), (4) Date: Dec. 13, 2002

(87) PCT Pub. No.: WO02/094704

PCT Pub. Date: Nov. 28, 2002

(65) Prior Publication Data

US 2003/0154688 A1 Aug. 21, 2003

(30) Foreign Application Priority Data

May 18, 2001 (DE) ..... 101 24 659

(51) Int. Cl.
*B65B 57/00* (2006.01)
*B65B 7/28* (2006.01)
*B67B 3/20* (2006.01)

(52) U.S. Cl. ..... 53/76; 53/331.5; 53/317

(58) Field of Classification Search ..... 53/331.5, 53/317, 331, 505, 506, 65, 70, 71, 76, 52, 53/53; 73/862.23, 862.331
See application file for complete search history.

(56) References Cited

U.S. PATENT DOCUMENTS 4,173,265 A * 11/1979 Kremer ..... 180/443
4,485,609 A 12/1984 Kowal
4,599,846 A * 7/1986 Ellis et al. ..... 53/331.5
4,614,077 A * 9/1986 Muto et al. ..... 53/490
4,674,264 A * 6/1987 Ellis et al. ..... 53/331.5
5,146,790 A * 9/1992 Fish ..... 73/862.336
5,248,940 A * 9/1993 Patience et al. ..... 324/207.15
5,253,525 A * 10/1993 Fukui et al. ..... 73/504.08
5,321,935 A 6/1994 Spatz et al.
5,655,357 A * 8/1997 Kristen ..... 53/512
5,996,311 A * 12/1999 Heard et al. ..... 53/317
6,070,506 A * 6/2000 Becker ..... 81/479
6,072,172 A * 6/2000 Duggan et al. ..... 250/221

FOREIGN PATENT DOCUMENTS

DE 3245966 7/1983
DE 4011398 10/1991
EP 467091 1/1992

* cited by examiner

*Primary Examiner*—Rinaldi I. Rada
*Assistant Examiner*—John Paradiso
(74) *Attorney, Agent, or Firm*—Marshall, Gerstein & Borun LLP

(57) ABSTRACT

A device for screwing a screw cap onto a container with a magnetic coupling arranged between a spindle which can be driven and the closing head, and in the circumferential area of permanent magnets connected to the closing head, an inductive detector for determining the state of motion is provided. As a result, the simplest means are provided to allow the monitoring of the number of revolutions of the closing head, and defects, such as incorrect container clamping, incorrect closing cone and incorrect threadings, can be readily detected.

12 Claims, 2 Drawing Sheets

DEVICE FOR SCREWING SCREW-TYPE CLOSURES ONTO CONTAINERS

FIELD OF THE INVENTION

The invention relates to a device for screwing caps onto containers, such as used in bottling beverage production operations.

Such a device is known from DE 32 45 966 C2. The slip or hysteresis coupling formed by the magnets and a ring made of a material with high magnetic permeability here provide a sensitive and reproducible adjustment of the torque which is transferred by the spindle to the closure head. This torque is applied, even if, for safety reasons, one continues to turn a screw cap on the threading of the container opening for a certain time period, and it leads, for example, in the case of incorrect threadings or incorrect container clamping, to a continuation of the turning of the screw head, which is a sign of an incorrect closing process. In the known device, no provision is made for monitoring this process.

BACKGROUND OF THE INVENTION

On the other hand, devices are already known for screwing screw caps onto containers, in which devices, the closing head can be driven directly by its own motor with adjustable torque (DE 40 11 398 C2). Here, the speed of rotation of the closing head is monitored by an angle of rotation sensor associated with it. This angle of rotation sensor controls, on the one hand, the drive motor for the closing head and, on the other hand, it generates, in connection with an evaluation device, an error signal when the closing head turns or does not turn at certain places. This leads to the removal of the corresponding incorrectly closed container.

The invention is based on the problem of providing simple means for monitoring the closing head rotation in a device of the type mentioned in the introduction.

In a device according to the invention, the permanent magnets, which are present anyway, of the slide or hysteresis coupling are used to monitor the turning of the closing head. Based on this double function of the magnet, according to the invention, the expenditure for the construction is extremely small. The magnets, in general, are arranged with good protection in a housing, so that a microbiologically advantageous construction of the closing device is not negatively affected.

In the simplest case, the detector has a coil, optionally with a soft iron core, which is located opposite the closing head. During a relative rotation between the coil and the magnet, a voltage is induced in the coil, which can be evaluated in a simple manner in a connected evaluation device.

If several devices are arranged on a common rotor, then the detector can be arranged, without problem, in a stationary position in a certain area of the circular path of the closing heads. Depending on whether or not the closing heads undergo, in addition to the circular motion, a rotation of their own, a different signal is then produced in the detector, which again can be evaluated in a simple manner.

The detector may, but does not have to, cover the entire circular path of the closing heads. According to a preferred variant of the invention, it merely monitors the area in which, during the normal course of the closing process, after the tightening of the screw cap with the set torque, the magnetic coupling of the closing head no longer undergoes a rotation of its own. However, if in that area, a rotation of the magnet itself is registered, then this indicates, among other facts, one or more of the following errors or defects:

a) The container continues to turn because of a defective or worn clamp;
b) The closing head continues to turn because of a worn toothing of the closing cone;
c) The screw cap continues to turn because of a defective threading on the closure or container.

All these cases, which lead to an incorrect fit of the screw cap, can be acquired by the stationary detector. By means of an evaluation device which is connected to the latter detector, it is then possible to trigger, as desired, for example, an alarm signal, to automatically remove the container with the defective closure from the circulation and/or to identify the closing head which has caused the incorrect fit.

BRIEF DESCRIPTION OF THE DRAWINGS

An embodiment of the invention is described below with reference to the drawing. In the drawing.

DETAILED DESCRIPTION OF THE INVENTION

Figure 1:
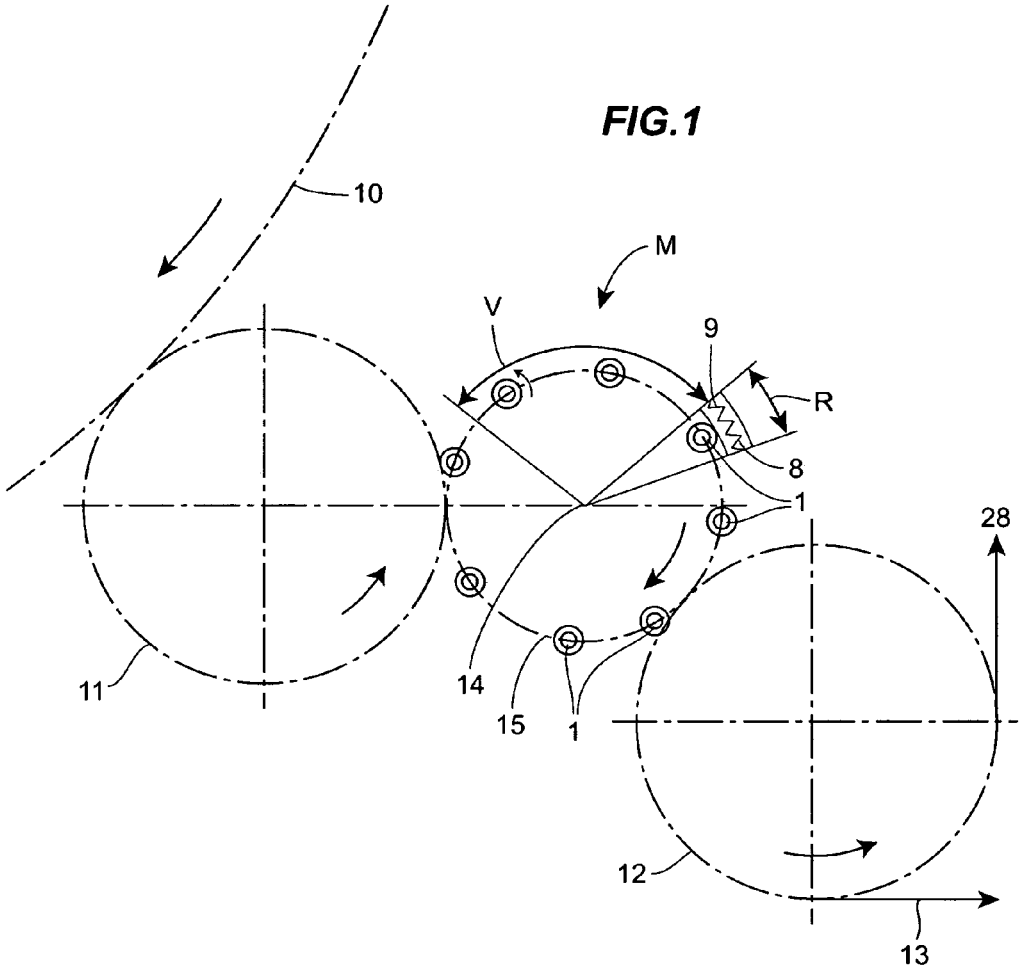
FIG. 1 shows the schematic top view of a closing machine for PET bottles, integrated in a filling installation

The closing machine M in FIGS. 1–4 is arranged for the continuous closing of PET bottles 3 with conventional screw caps which are made of plastic and installed in a filling installation. The latter, in addition, comprises a filling machine 10, a transfer star 11 which transfers the bottles 3 filled with a drink from the filling machine 10 to the closing machine M, as well as output star 12 which receives the filled and closed bottles 3 from the closing machine M and transfers them to a conveyor belt 13. Incomplete circles are used to indicate the filling machine 10, the transfer star 11 and the output star 12 in FIG. 1.

The closing machine M presents a rotor 15 which can be driven continuously about a vertical axis 14 in the direction of the arrow, and on which several identical closing devices 1 are arranged, evenly distributed over the circumference.

Figure 4:
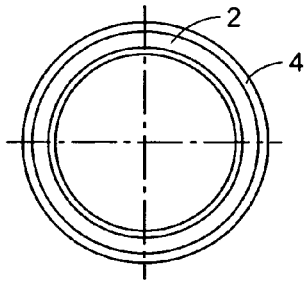
FIG. 4 shows the top view of the hysteresis ring of the closing device according to FIG. 2.

The structure of one of these closing devices 1 is further explained below with reference to FIGS. 2–4.

The device 1 presents a spindle 4 with vertical axis of rotation, which is rotatably attached in the rotor 15. The spindle 4 consists of several parts, which are all cross hatched with an upward slope to the right. In the lower hollow terminal area of the spindle 4, a closing head 5 is rotatably attached, also with vertical axis of rotation, by means of two roller bearings 16. The closing head 5 also consists of several parts, which are all cross hatched with upward slope to the left. In the lower area, the closing head 5 presents, in the conventional manner, a spring-mounted holding down clamp 17, a toothed closing cone 18, as well as an elastic holder 19 for the screw caps which are not shown.

Figure 3:
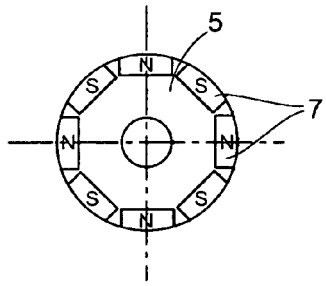
FIG. 3 shows the top view of the magnet arrangement of the closing device according to FIG. 2

On the outside of the closing head 5, eight permanent magnets 7 with alternating polarity are attached, as shown in FIG. 3. The cylindrical arrangement of the permanent magnets 7, on the outside, is surrounded concentrically by hysteresis ring 2 made of a material with high permeability, for example, soft iron, which is attached to the internal side of the spindle 4 at the height of the permanent magnets 7. The permanent magnets 7 and the hysteresis ring 2 together form a magnetic coupling 6, more precisely a hysteresis coupling, which transfers, in a large range of rpm values, a predetermined torque from the driven spindle 4 to the closing head 5 which is rotatably attached relative to it. The size of the torque can be adjusted by adjusting the height of the hysteresis ring 2; in FIG. 2, on the left side, the setting with maximum torque is shown, and on the right side, the setting with minimum torque. The permanent magnets 7 here remain at the same height.

Figure 2:
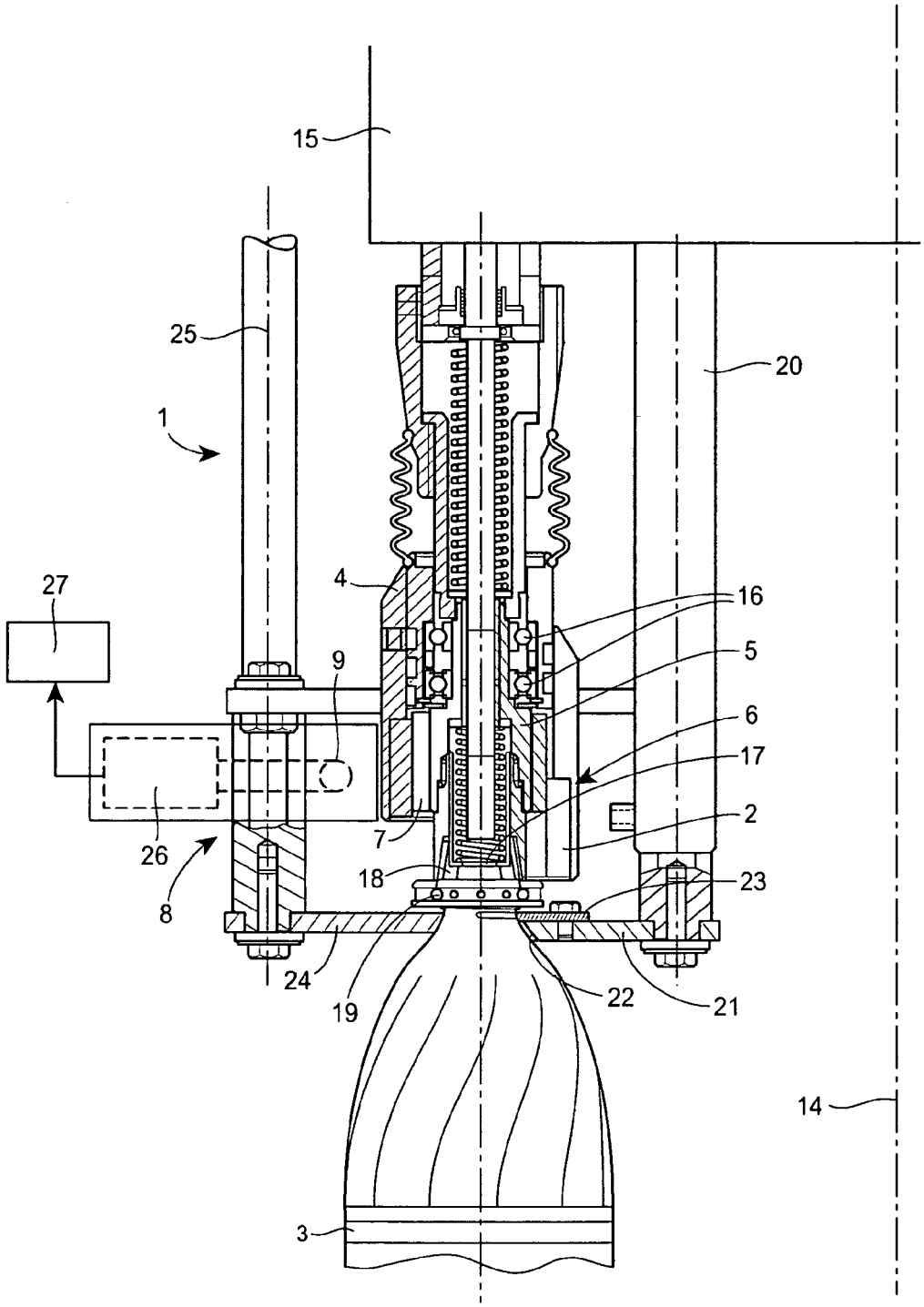
FIG. 2 shows the vertical cross section through an individual closing device of the closing machine according to FIG. 1 in the area of the angle R

As indicated in FIG. 2, a horizontal holder plate 21 for a bottle 3 to be closed is attached to the bottom side of the motor 15 for each closing device 1 by means of vertical rods 20, which holder plate presents a U-shaped recess 22 which opens radially outward for the neck of the bottle. On the top side of the holder plate 21, a support 23, which is provided with several tips which are directed upward, is attached. The bottle 3 to be closed, with its support ring, lies on the support 23 or on its tips, and it is thus protected from rotation as a result of the combined action of the application pressure exerted by the spring-mounted down holding clamp 17. By means of a stationary guide arc 24, the bottle 3 is held in the recess 22. The guide arc 24 brushes over the entire transport area of the bottles 3 in the area of the closing machine M and it is attached with several stationary columns 25 to the upper part of the rotor 15 which does not rotate, and which is not shown. No bottom support for the bottle 3 is provided.

In the operation of the closing machine M, while the rotor 16 turns, the spindles 4 themselves are set into rotation by a planetary gear system which is not shown, namely in the angle range of their circumferential path, which is marked with V and R. Here, the closing angle marked with V is required for a proper closing of the bottle 3, where the spindles 4 and the closing head 5 which is moved along by the hysteresis coupling 6 undergo at most approximately 2.7 rotations with the conventional screw caps. After that, the screw cap is firmly screwed on the bottle 3 with the set torque, and the bottle is then properly sealed. Within the remaining angle of the circumferential path, which is marked with R, the spindles 4 continue to be set in rotation; in contrast, the closing heads 5 here normally stand still, where the slide is taken up by the hysteresis coupling 6.

In the area of the residual angle R, a stationary detector 8 is arranged for monitoring the number of revolutions of the closing heads 5. The detector 8 is rigidly attached to the guide floor 24 or its support column 25, namely at the height of the permanent magnets 7. With its sensor surface which is turned toward the axle 14, it is located at a small distance from the circular path of the spindles 4. In the area of the sensor surface, in the housing of the detector 8, a longitudinal coil 9 with good electrical conductivity is inserted in a manner so it provides a seal against fluid, which coil is connected to a detection circuit 26. The coil 9 is oriented horizontally and, in the embodiment example, it exactly covers the residual angle R.

If a closing head 5 without rotation of its own moves past the detector 8, then, depending on the angular position of the permanent magnets 7, a voltage, which varies in size but is constant, is induced in the coil 9. In contrast, if the closing head 5 as it passes the detector 8 has a rotation of its own, then a pulsing or alternate current is induced by the permanent magnets 7 which rotate as they move past the coil 9. This different current or signal pattern can be distinguished without any problem by the detection device 26. The latter device generates an error signal if it senses a pulsing or alternate current. This error signal is sent on to an evaluation device 27 which is connected to the connector 8.

The evaluation device 27, in the simplest case, triggers an alarm signal which alerts the operating personnel to the presence of the closing head 5 which continues to turn, and which is the sign of one of the defects a) to c) described in the introduction of the description. It is also possible for the evaluation device 27 to trigger, when an error signal is received, the removal of the bottle 3 which has been processed by the closing head 5 which continues to turn. This can be achieved, for example, with the aid of controllable clamps, not shown, in the output star 12, which remove the defective bottles to a separate conveyor 28. Furthermore, it is advantageous to couple the evaluation device 27 with a bottle sensor, which is not shown, and which, if no bottle 3 is present under a closing head 5 which continues to turn, suppresses an erroneous error signal. Furthermore, it is possible for the evaluation device 27 to identify and display the closing head which continues to turn, for which purpose, for example, an angle coder is connected, which monitors the exact angular position of the rotor 15. The angle coder is also advantageous for communicating the given speed of the rotor 5 or of the spindles 4 to the evaluation device 27 or the detection circuit 26.

In the present case, the hysteresis ring 2 of the magnetic coupling 6 is also arranged between the permanent magnets 7 on the closing head 5 and the detector 8. This arrangement does not interfere with the evaluation by the coil 9 because the hysteresis ring 7, while presenting a high permeability, does not have its own magnetic field. In a manner of speaking, the magnetic fields generated by the permanent magnets 7 break through the hysteresis ring 2 to the coil 9.

I claim:

1. Device (1) for screwing a screw cap onto a container (3), comprising a spindle (4) which can be driven, a closing head (5) which can be rotated with respect to the spindle, a magnetic coupling (6) between the spindle and the closing head (5), a plurality of permanent magnets (7) rotatably connected to the closing head, and a detector (8) arranged to determine a state of movement of the permanent magnets (7).

2. Device according to claim 1 wherein the detector (8) presents at least one electric coil (9) in which a voltage can be induced by the permanent magnets (7) which move by as they rotate.

3. Device according to claim 1 wherein the detector (8) is arranged in a fixed position opposite the closing head (5).

4. Device according to claim 1 wherein the closing head (5) moves on a circular path and the detector (8) is arranged in a stationary position on the circular path of the closing head (5) at the height of the permanent magnets (7).

5. Device according to claim 4 wherein the detector (8) is arranged in a residual angle (R) of the circular path of the closing head (5), which residual angle follows a closing angle (V) and in which there is normally no rotation of the closing head (5) itself during a proper closing process.

6. Device according to claim 1 wherein an evaluation device (27) is connected to the detector (8), which evaluation device triggers an alarm in the case of registration by the detector (8) of an incorrect state of movement of the permanent magnets (7), and which triggers the removal of the container processed by the closing head (5) which continues to turn or the identification of the closing head (5) which continues to turn.

7. Device according to claim 1, wherein the detector (8) is an inductive detector.

8. Device (1) for screwing a screw cap onto a container (3), the device comprising:

a spindle (4) which can be driven;

a closing head (5) which moves along a circular path with respect to the spindle;

a magnetic coupling (6) between the spindle and the closing head (5);

a plurality of permanent magnets (7) connected to the closing head; and a detector (8) arranged in a stationary position on the circular path of the closing head (5) at the height of the permanent magnets (7) to determine a state of movement of the permanent magnets.

9. Device according to claim 8 wherein the detector (8) presents at least one electric coil (9) in which a voltage can be induced by the permanent magnets (7) which move by as they rotate.

10. Device according to claim 8 wherein the detector (8) is arranged in a residual angle (R) of the circular path of the closing head (5), which residual angle follows a closing angle (V) and in which there is normally no rotation of the closing head (5) itself during a proper closing process.

11. Device according to claim 8 wherein an evaluation device (27) is connected to the detector (8), which evaluation device triggers an alarm in the case of registration by the detector (8) of an incorrect state of movement of the permanent magnets (7), and which triggers the removal of the container processed by the closing head (5) which continues to turn or the identification of the closing head (5) which continues to turn.

12. Device according to claim 8 wherein the detector (8) is an inductive detector.

* * * * *

UNITED STATES PATENT AND TRADEMARK OFFICE

CERTIFICATE OF CORRECTION

PATENT NO. : 7,124,552 B2
APPLICATION NO. : 10/311180
DATED : October 24, 2006
INVENTOR(S) : Horst Lang It is certified that error appears in the above-identified patent and that said Letters Patent is hereby corrected as shown below:

On the Title Page:

Item (30), "101 24 659" should be -- 101 24 659.5 --

Signed and Sealed this

Twenty-fourth Day of April, 2007

JON W. DUDAS
*Director of the United States Patent and Trademark Office*